US010101079B2

(12) United States Patent
Cetinyol et al.

(10) Patent No.: US 10,101,079 B2
(45) Date of Patent: Oct. 16, 2018

(54) COOLING DEVICE HAVING A STORAGE PLATE COMPRISING A PROFILE

(71) Applicant: BSH Hausgeräte GmbH, München (DE)

(72) Inventors: Dogukan Cetinyol, Istanbul (TR); Bilal Cinici, Tekirdag (TR); Tanzer Yildizgöcer, Tekirdag (TR); Süleyman Özkan, Tekirdag (TR); Laura Ringemann Springer, Hohenbrunn (DE); Sebastian Knöll, Hamburg (DE)

(73) Assignee: BSH Hausgeräte GmbH, Munich (DE)

( * ) Notice: Subject to any disclaimer, the term of this patent is extended or adjusted under 35 U.S.C. 154(b) by 303 days.

(21) Appl. No.: 14/703,058

(22) Filed: May 4, 2015

(65) Prior Publication Data

US 2015/0323242 A1 Nov. 12, 2015

(30) Foreign Application Priority Data

May 7, 2014 (TR) ..... a 2014/05104

(51) Int. Cl.
*F25D 25/02* (2006.01)
*F25D 23/00* (2006.01)

(52) U.S. Cl.
CPC ..... *F25D 25/02* (2013.01); *F25D 23/00* (2013.01)

(58) Field of Classification Search
CPC ..... F25D 25/02; F25D 23/00
See application file for complete search history.

(56) References Cited

U.S. PATENT DOCUMENTS 1,119,982 A * 12/1914 Ohstrand ..... F25D 25/02 211/153
2,149,603 A * 3/1939 Hamby ..... F25D 25/02 108/110
2,568,153 A * 9/1951 Hickman ..... F24C 15/16 211/153
3,611,548 A * 10/1971 Parris ..... B27G 5/00 108/92
4,699,836 A * 10/1987 Fearon ..... B32B 3/12 156/304.1
4,716,840 A * 1/1988 Tringali ..... B43L 5/02 108/27
5,573,322 A * 11/1996 Wrobel ..... A47B 96/021 108/27
6,135,581 A * 10/2000 Kopp ..... A47B 77/022 108/27
6,558,601 B1 * 5/2003 Reames ..... B29C 45/14434 264/271.1
6,871,923 B2 * 3/2005 Dietz ..... F25D 25/02 108/27
6,928,786 B2 * 8/2005 Orozco ..... A47B 95/043 52/796.12
6,994,411 B2 * 2/2006 Johnson ..... A47F 3/0447 312/408

(Continued)

*Primary Examiner* — Hanh V Tran
(74) *Attorney, Agent, or Firm* — Nixon & Vanderhye P.C.

(57) ABSTRACT

The invention is a cooling device (1), particularly a domestic refrigerator, having a storage plate (10) for storing an item disposed in the cooling device (1) and a profile (20) disposed on an edge (15) of the storage plate (10) and that the cooling device (1) comprises a profile (20) configured as being on the same level with or a lower level than an upper face (11) of the storage plate (10) when the profile (20) is disposed on the edge (15) of the storage plate (10).

16 Claims, 5 Drawing Sheets

(56) References Cited

U.S. PATENT DOCUMENTS

| | | | | |
|---|---|---|---|---|
| D694,292 | S * | 11/2013 | Eby | D15/89 |
| 8,651,600 | B2 * | 2/2014 | Cheong | F25D 23/00 108/108 |
| 8,926,034 | B2 * | 1/2015 | Park | A47B 96/025 108/102 |
| 8,960,827 | B2 * | 2/2015 | McMillin | A47B 96/027 108/108 |
| 2003/0222043 | A1 * | 12/2003 | Rouch | A47B 96/062 211/153 |
| 2006/0213849 | A1 * | 9/2006 | Bienick | A47B 96/028 211/90.02 |
| 2010/0102693 | A1 * | 4/2010 | Driver | A47B 95/043 312/408 |
| 2013/0037505 | A1 * | 2/2013 | Driver | A47B 95/043 211/153 |
| 2013/0081422 | A1 * | 4/2013 | Park | F25D 11/00 62/448 |
| 2014/0123882 | A1 * | 5/2014 | Kassanoff | A47B 41/00 108/26 |

* cited by examiner

COOLING DEVICE HAVING A STORAGE PLATE COMPRISING A PROFILE

This application claims priority to TR Patent Application No. 2014/05104 filed 7 May 2014, the entire contents of which is hereby incorporated by reference.

TECHNICAL FIELD

The present invention relates to a cooling device comprising a profile disposed on the edge of a storage plate. The present invention particularly relates to a refrigerator, particularly a domestic refrigerator having a shelf.

KNOWN STATE OF THE ART

A profile is disposed on at least one edge of the plate-shaped shelves of refrigerators used for storing items. The profile is obtained from materials like metal or plastic.

If said profile is obtained from a substantially resistant material, it supports the storage plate/shelf, on whose edge it is placed, against bending and flexing which occur due to the loads applied thereon. Therefore, the profile is connected to one or more than one edge of the shelf, which is in quadrangle (rectangle, square, etc.) shape.

The profile may, moreover, be used for creating visual difference. By means of profiles having different color, structure and dimensions, shelves and thus cooling devices, which are different from each other, can be obtained. The profile, used for this purpose, can support the shelf as mentioned above, or optionally it may be a profile, which does not support the shelf.

The shelf edge, which is mostly preferred for both purposes, is the front edge. The profile, used in the art, is generally positioned by grabbing the shelf edge from below and from above (FIG. 8 and FIG. 9). Therefore, the profile creates an elevation on the upper face of the shelf. This elevation is contacted during production, during transportation or during taking an item, disposed on the shelf, from the shelf, and the profile may accidentally get separated from the shelf. Moreover, in case a fluid foodstuff is poured onto the shelf accidentally, said foodstuff may also penetrate between the profile and the shelf. Since the foodstuff penetrated in between cannot be completely cleaned, it may lead to bacteria formation and bed smell formation. This may lead to an unhygienic situation which disturbs the user.

The invention provides an additional improvement, an additional advantage or an alternative to the present art.

OBJECT OF THE INVENTION

The main object of the present invention is to provide a cooling device having a storage plate comprising a profile providing a long lifetime usage.

In order to realize said object, the present invention is a cooling device, particularly a domestic refrigerator, having a storage plate for storing an item disposed in the cooling device and a profile disposed on an edge of the storage plate; and that the cooling device comprises a profile configured as being on the same level with or a lower level than an upper face of the storage plate when the profile is disposed on the edge of the storage plate. Thus, a protrusion or step, which leads to the risk of profile impact or catching risk, is not formed on the storage plate. This eliminates or relatively reduces the risk of accidental separation of the profile from the storage plate.

The cooling device described in the present invention can be a device having storage plate, particularly a freezer or a refrigerator, particularly a domestic refrigerator. The cooling device may have a chamber thermally isolated from the outer environment. The cooled chamber can be accessed through a door provided on any wall of the chamber, particularly on the front or upper wall of the chamber. There may be one door or more than one door. The door can be connected by means of a hinge or by means of another method and mechanism known in the related art and providing door performing pivotal movement. Sealing element can be positioned on the periphery of the door for providing thermal isolation. The sealing element can be a gasket or a different element used in cooling devices in the related art.

The storage plate can embodied so as to bear an item which is desired to be kept in a cool medium in a cooling device. For instance, the storage plate may be a shelf carrying a foodstuff placed into a domestic refrigerator. The shelf is particularly made of glass, or it may be made of any material like plastic and metal or a suitable composite material known to be used in the production of shelves.

The profile may be an item used for increasing the resistance of the storage plate against flexing/bending due to the load placed thereon or against a possible impact to the storage plate; or used for creating visual difference. The profile can be obtained from a material, known in the related art, like metal, plastic, silicon or composite. For instance, the following can be used for obtaining the profile: aluminum, steel, thermoplastics (Acrylonitrile butadiene styrene (ABS), ABS/PC (Acrylonitrile butadiene styrene/Polycarbonate composite), polystyrene (PS), Styrene butadiene rubber (SBR)), thermoplastic elastomers or thermoplastic vulcanized units (Ethylene-Propylene-Diene-Monomer (EPDM), natural rubber (NR), Nitrile butadiene rubber (NBR), chloroprene rubber (CR), polyvinyl chloride (PVC), soft polyvinyl chloride (PVC)), etc. For instance, a section or whole of the profile may be hollow. Thus, since the amount of material used for obtaining the profile will be small, the production cost can be kept at a low level.

In a probable embodiment of the present invention, the profile comprises an upper face configured as being flush with the upper face of the storage plate when the profile is disposed on the edge of the storage plate. Thus, a surface can be obtained which is flush with the storage plate.

In a probable embodiment, the storage plate and the profile are configured as contacting on each points being on a line where upper faces of the storage plate and the profile are connected. Thus, the storage plate and the profile can be joined without any gap in between. By means of this, in case fluid is poured on the storage plate, fluid can be prevented from being penetrating between the storage plate and the profile. In this case, for instance if the fluid is a foodstuff, foodstuff penetration between the storage plate and the profile can be prevented; and thus odor and/or bacteria formation can be prevented.

In a probable embodiment of the present invention, the profile comprises an inclined edge being far from the storage plate. In another probable embodiment of the present invention, the profile comprises a rounded edge being far from the storage plate. Thus, due to any reason like cleaning, a contact, applied to the storage plate and to the profile, can be realized without being prevented. By means of this, the physical damaging of the contacting person can be prevented. Particularly the edges of the profile, obtained from hard materials and to which the user probably contacts, can be prevented from giving damage to the user.

In a probable embodiment of the present invention, the profile comprises a fixing element. Thus, the profile fixing process can be realized in a relatively rapid manner. In a probable embodiment, the fixing element is configured as extending over at least one of the lower face and the side face of the storage plate. Thus, in a compliant manner to the object of the invention, a protrusion, which leads to the risk of catching and impact, is not formed on the storage plate.

In a probable embodiment of the present invention, the storage plate comprises a step configured as providing that the profile is on the same level with or a lower level than the upper face of the storage plate when the profile is disposed on the storage plate. Thus, the profile can be placed on the edge of the storage plate as a coating. By means of this, a profile can be obtained, which seems to have the desired width, by using less material, as opposed to a profile having the same width. The profile can be formed by means of shaping methods known in the related art, like extrusion.

In a probable embodiment of the present invention, the fixing element is configured as extending over the step of the storage plate. Thus, the profile is fixed, and at the same time, in a compliant manner to the object of the invention, a protrusion, which leads to the risk of catching and impact, is not formed on the storage plate.

The profile may extend along an edge of the storage plate. However, optionally, the profile as a whole; or the visual section, part of the profile other than the fixing element of the profile; and/or the fixing element may extend along only a section of said edge. In other words, a partial profile, visual section and/or fixing element can be provided when compared with the length of the edge. Again, optionally, the profile, the visual section and/or the fixation element can be provided as repeated having a distance there between. The number of said distances can be one or more than one. For instance, a profile can be provided comprising two fixing elements provided only at the two ends, despite a visual section extending along the edge. Or for instance, a profile can be obtained disposed on the middle section and occupying only one-third of the edge. Pluralities of such examples can be obtained as combinations within the above-mentioned limits.

In a probable embodiment of the present invention, the cooling device comprises an adhesive layer disposed between the fixing element of the profile and the storage plate. Thus, a resistant fixation can be provided. For instance, a layer can be formed by means of the adhesives cured with ultraviolet (UV) light. This provides a firm connection.

In a probable embodiment of the present invention, the fixing element of the profile comprises a rounded edge and/or an inclined edge. Thus, due to any reason like cleaning, a contact, applied to the storage plate and to the profile, can be realized without being prevented. By means of this, the physical damaging of the contacting person can be prevented. Particularly the edges of the profile, obtained from hard materials and to which the user probably contacts, can be prevented from giving damage to the user.

In a probable embodiment of the present invention, the profile is configured as covering, at least partially, a front face of the storage plate. Thus, the storage plate can be protected against the impacts which may be applied onto the front face thereof. For instance, the front face of a storage plate made of glass can be protected by means of a profile made of a resistant material like metal or plastic.

In a probable embodiment of the present invention, the length of the profile is almost equal to the length of the edge of the storage plate. Thus, all of said advantages of the profile can be obtained on the whole edge. For instance, the storage plate can be protected by means of the profile against any impact which may be applied onto the related edge.

In a probable embodiment of the present invention, the edge of the storage plate is the front edge. Thus, the advantages of the invention can be obtained on the edge with which the user most frequently interacts.

THE DETAILED DESCRIPTION OF THE INVENTION

Figure 1:
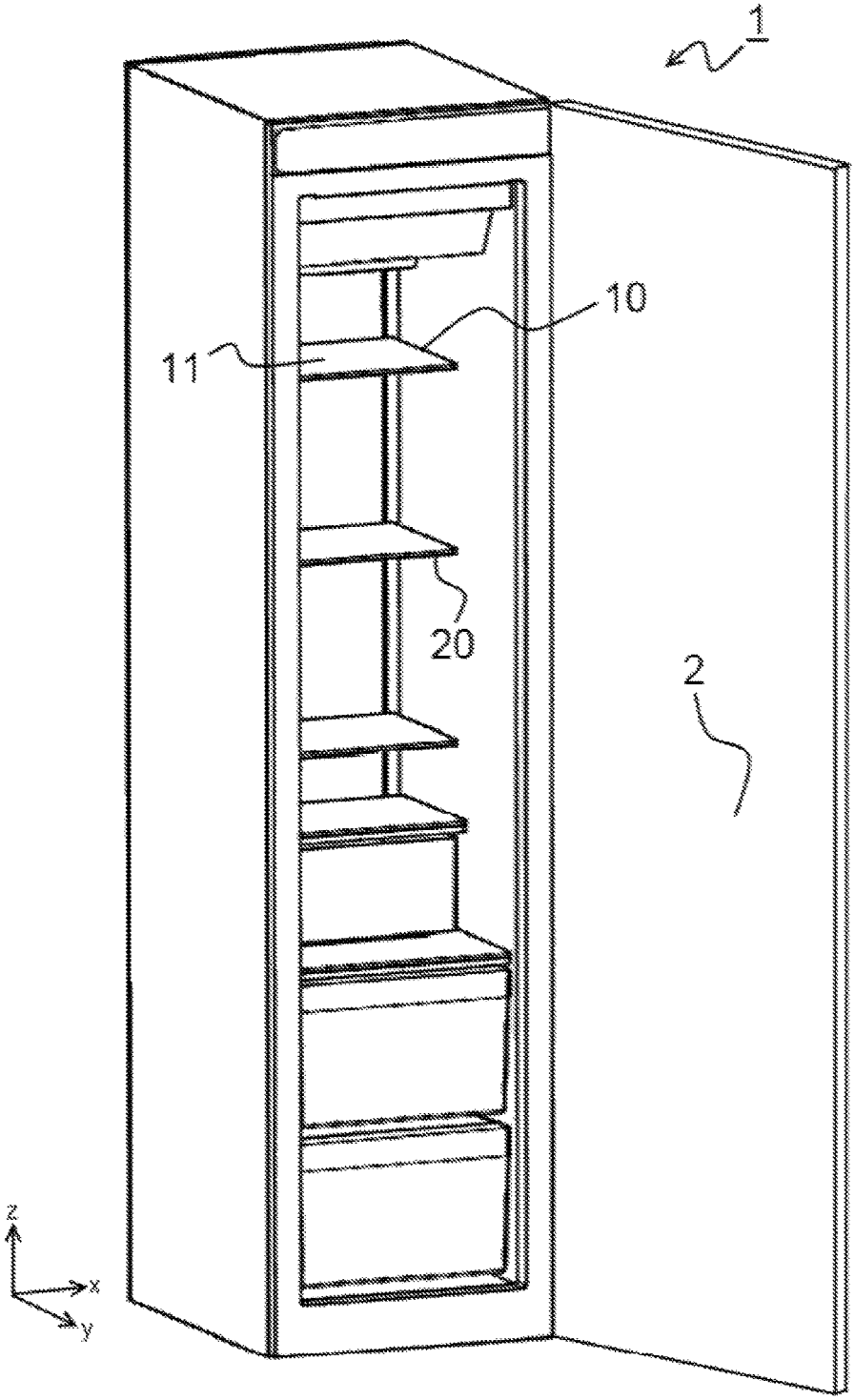
FIG. 1 is the perspective view of a domestic freezer which is a probable cooling device. The door of the freezer which closes the front opening has not been shown.

All directional references such as front, top and bottom are based on reference to the cooling device (1) shown in FIG. 1, where the section viewed from the direction x is described as "left", the section viewed from the direction y is described as "rear", and the section viewed from the direction z is described as "bottom". One or more of probable embodiments of the present invention will be described as examples in detail below. The probable cooling device (1), presented in FIG. 1, is a domestic freezer. The freezer storage plate (10) comprises glass shelves. Even though not illustrated in FIG. 1, there is a door (2) closing the freezer chamber, determined by the freezer, from the front face thereof.

Figure 2:
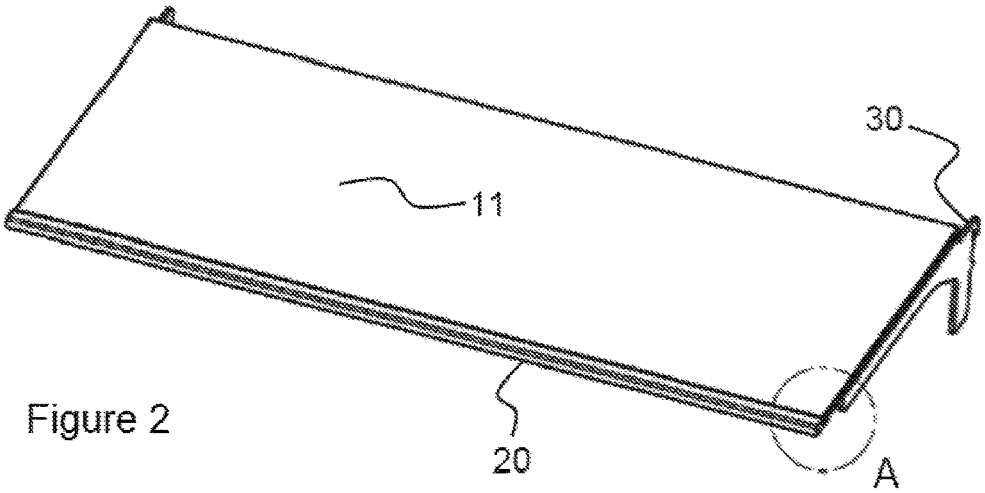
FIG. 2 is the perspective view of a storage plate having a probable profile.

In FIG. 2, the glass shelf used as the storage plate (10), the support element (30) carrying the glass shelf and the profile (20) provided on the front edge (15) of the glass shelf are illustrated. The profile (20) extends along the front edge (15) of the shelf comprising glass plate.

Figure 3:
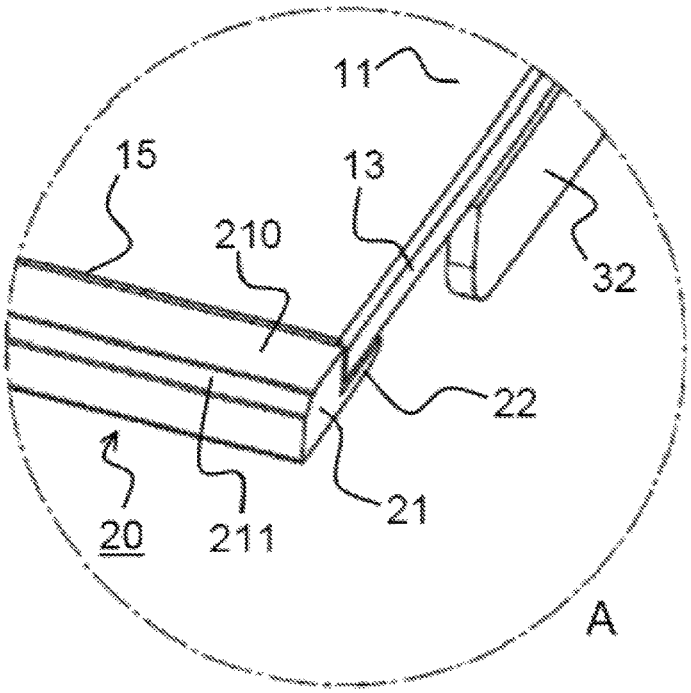
FIG. 3 is the view of Detail A taken from FIG. 2.

FIG. 3 is the view of Detail A taken from FIG. 2. In the detail, the front edge (15) of the glass storage plate (10), the right end of the profile (20), and the front end of the support element (30) are illustrated. The section of the profile (20) provided in front of the storage plate (10) is defined as the visual section (21). There is a fixing element (22) extending from the visual section (21) towards the bottom face (12) of the storage plate (10). In a probable embodiment, the visual section (21) and the fixing element (22) extend along the edge (15) of the storage plate (10).

Figure 4:
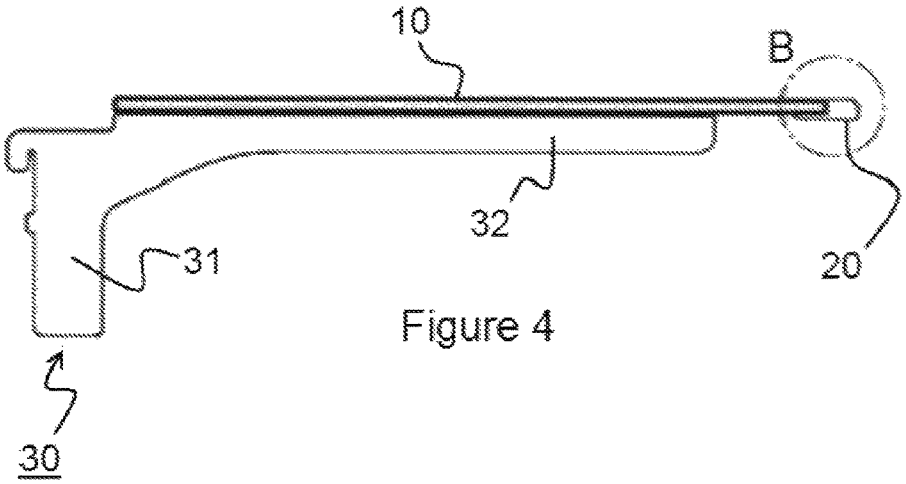
FIG. 4 is the left-hand view of the storage plate illustrated in FIG. 2.

FIG. 4 is the left-hand view of the storage plate (10) illustrated in FIGS. 2 and 3. In this figure, the support element (30), the storage plate (10) provided on the support element (30), and the profile (20) positioned on the front edge (15) of the storage plate (10) can be seen. The support element (30) is one of the two plates positioned inside the cooling device (1) in a parallel manner with respect to each other for each storage plate (10). In the embodiment presented in the figures, the support element (30) is positioned on the inner rear wall of the cooling device (1). Therefore, it comprises a hanger section (31), and a support section (32) extending forward from the hanger section (31). The support sections (32) of the two parallel support elements (30) support and carry the storage plate (10) from below. Moreover, the support element (30) and the storage plate (10) can be fixed to each other by means of items like adhesives or mechanical fasteners (screw, rivet, etc.).

Figure 5:
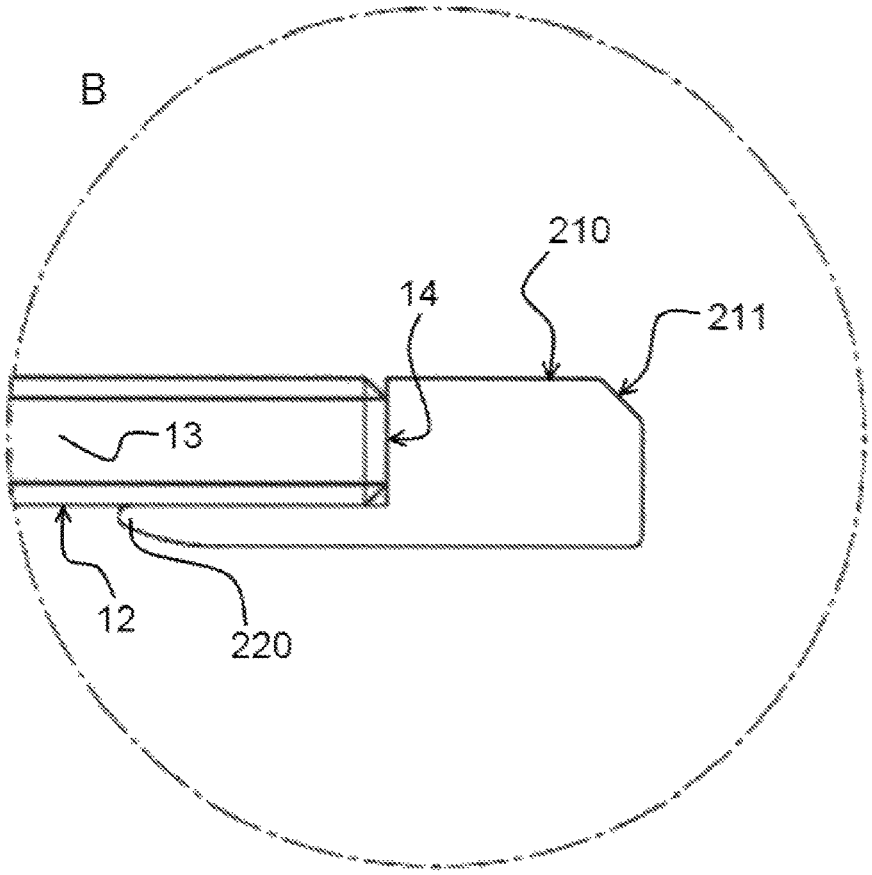
FIG. 5 is the view of Detail B taken from FIG. 4.

FIG. 5 is the view of Detail B taken from FIG. 4. The visual section (21) of the profile (20) completely covers the front of the front edge (15) of the storage plate (10). The upper face (210) of the visual section (21) and the upper face (11) of the storage plate (10) are flush with each other. In other words, they are on the same imaginary plane. The visual section (21) roughly has a quadrangular cross section. However, the front upper edge is provided as an inclined edge (211). There is a fixing element (22) extending from the rear bottom edge of the quadrangle towards the bottom of the storage plate (10).

The fixing element (22) is in plate form. Adhesive is applied between the storage plate (10) and the face of the fixing element (22) facing the storage plate (10), and thereby the profile (20) is fixed to the storage plate (10). The adhesive can be an adhesive, cured with ultraviolet (UV) light. The adhesive can also be applied between the visual section (21) and the front face (14) of the storage plate (10). The rear edge of the plate forming the fixing element (22) is formed as the rounded edge (220). Thus, it does not have sharp lines.

Figure 6:
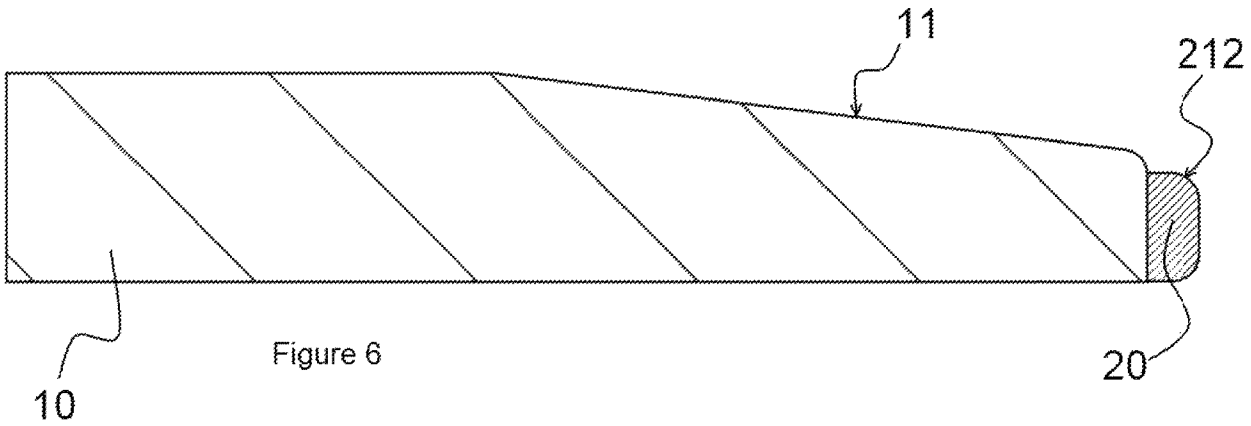
FIG. 6 is a cross sectional left-hand view illustrating the position of a probable second profile on the front edge of the storage plate.

FIG. 6 presents another probable embodiment of the present invention. Accordingly, a profile (20) is used which is fixed to the front face (14) of the storage plate (10). The profile (20) covers a vertical section of said front face (14). The profile (20) extends along said front edge (15). The profile (20) is adhered to the front face (14). The profile (20) has a quadrangular cross section. The edges and particularly the front edges are rounded edges (212). In this embodiment, the upper face (210) of the profile (20) remains at a lower level when compared with the upper face (11) of the storage plate (10). In other words, they are not at the same level.

As exemplified in FIG. 6, the upper face (11) of the storage plate (10) which is close to the front edge (15) can be formed in an inclined manner.

Figure 7:
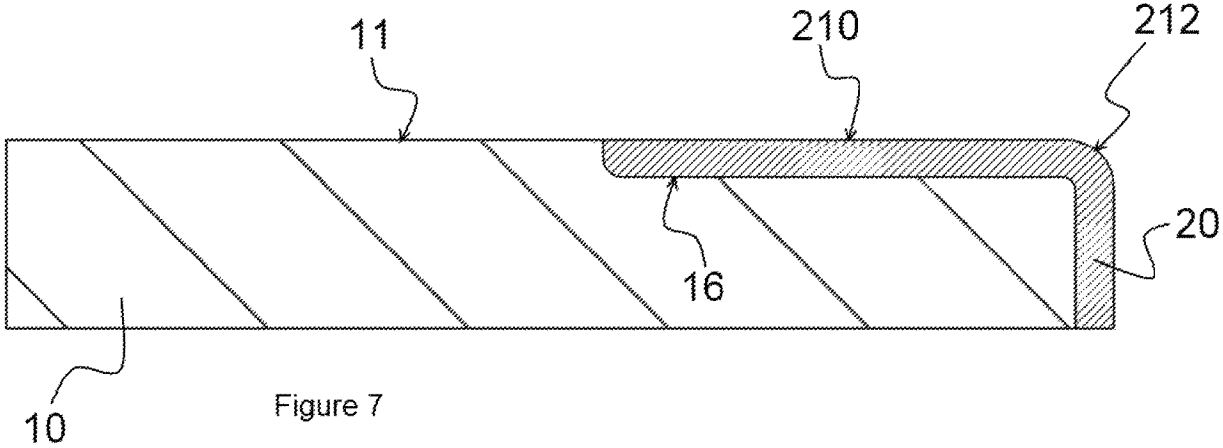
FIG. 7 is a cross sectional left-hand view illustrating the position of a probable third profile on the front edge of the storage plate.
Figure 8:
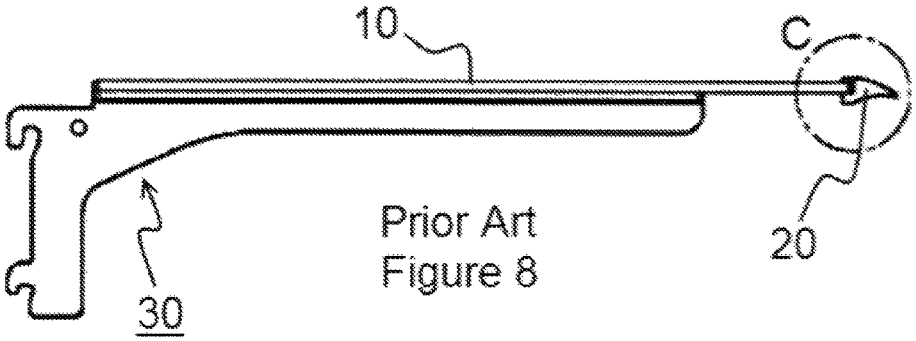
Prior Art Figure 8
FIG. 8 is the left-hand view of a storage plate having a profile of the present art.
Figure 9:
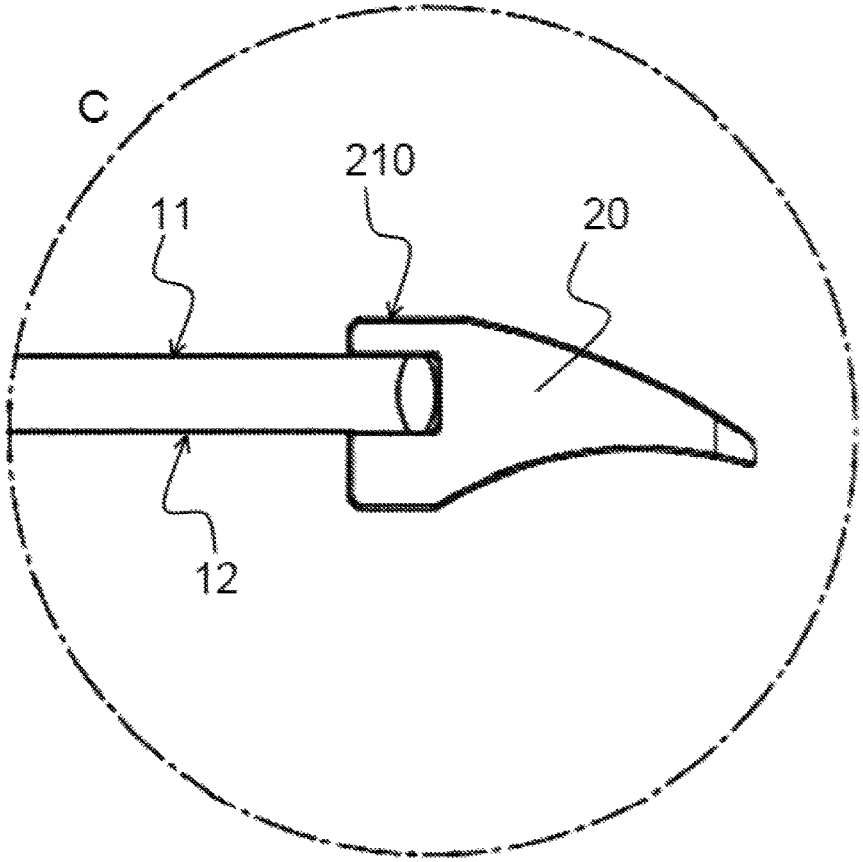
Prior Art Figure 9
FIG. 9 is the view of Detail C taken from FIG. 8.

FIG. 7 presents another probable embodiment of the present invention. On the front edge (15) of the storage plate (10), a step (16) is formed. In other words, the section of the upper face (11) of the storage plate (10) which is close to the front edge (15) is provided on a plane lower than the remaining upper face (11). Thus, a step (16) is obtained on the upper face (11). The profile (20) is provided in a structure covering the front face (14) of the storage plate (10) and placed to the step (16). In a similar manner to the first embodiment, the section covering the front face (14) can be considered as the visual section (21), and the section placed to the step (16) can be considered as the fixing element (22). The section of the profile (20) placed to the step (16) has the same cross section as the step (16). The upper face (210) of the section of the profile (20) placed to the step (16), and the upper face (11) of the storage plate (10), are flush with each other. However, in a compliant manner to the invention, the upper face (210) of the profile (20) can also be provided so as to be at a lower level. The front upper edge of the profile (20) is provided as the rounded edge (212). As in the first embodiment, an inclined edge (211) can be provided instead of the rounded edge (212).

REFERENCE NUMBERS

1. Cooling device
2. Door
10. Storage plate
11. Upper face
12. Lower face
13. Side face
14. Front face
15. Edge
16. Step
20. Profile
21. Visual section
210. Upper face
211. Inclined edge
212. Rounded edge
22. Fixing element
220. Rounded edge
30. Support element
31. Hanger section
32. Support section

The invention claimed is:

1. A domestic refrigerator having a storage plate configured to store an item disposed in the domestic refrigerator, the storage plate having a rear edge, a right side with a right lateral edge, a left side with a left lateral edge, and a front edge that extends from the right lateral edge to the left lateral edge, and a profile disposed on the front edge of the storage plate, a right support element located on the right side of the storage plate and a left support element located on the left side of the storage plate, the right support element includes a right support section that extends forward from a right hanger section, the left support element includes a left support section that extends forward from a left hanger section, the left hanger section and the right hanger section positioned on an inner rear wall of the domestic refrigerator proximate the rear edge of the plate, wherein the right support section supports the right side of the storage plate from a rear edge toward the front edge, and the left support section supports the left side of the storage plate from the rear edge toward the front edge, wherein the profile is on the same level with or a lower level than an upper face of the storage plate when the profile is disposed on the front edge of the storage plate, the profile including a fixing element and a visual section, an adhesive disposed between the fixing element and the storage plate, a contact line between a distal end of the front edge of the storage plate and the visual section, the visual section directly contacting the storage plate along the contact line, wherein the storage plate has a vertical front face located at the distal end of the front edge of the storage plate, the vertical front face extending along the contact line and being substantially perpendicular to a bottom face and the upper face of the storage plate, and wherein the fixing element extends from a bottom portion of the visual section and is located exclusively adjacent to the bottom face of the storage plate; and wherein the upper face of the plate is unencumbered by the profile.

2. The domestic refrigerator according to claim 1; wherein the profile comprises an upper face configured as being flush with the upper face of the storage plate when the profile is disposed on the front edge of the storage plate.

3. The domestic refrigerator according to claim 2; wherein the contact line is located where upper faces of the profile and the storage plate are connected.

4. The domestic refrigerator according to claim 1; wherein the visual section of the profile comprises an inclined edge or rounded edge being far from the storage plate such that the visual section is thicker adjacent the storage plate than at a front face of the visual section.

5. The domestic refrigerator according to claim 1; wherein the fixing element of the profile comprises a rounded edge.

6. The domestic refrigerator according to claim 1; wherein the fixing element of the profile comprises an inclined edge.

7. The domestic refrigerator according to claim 1; wherein the profile is configured as covering, at least partially, the vertical front face of the storage plate.

8. The domestic refrigerator according to claim 1; wherein the length of the profile is almost equal to the length of the front edge of the storage plate.

9. The domestic refrigerator according to claim 1, wherein the right support section and the left support section are spaced from the front edge of the storage plate, and the profile includes an inclined edge that is spaced from the storage plate.

10. The domestic refrigerator according to claim 1, wherein the visual section has a different cross sectional shape than the fixing element.

11. The domestic refrigerator according to claim 1, wherein an outer face of the visual section is spaced a first distance from the front edge of the storage plate, and an outer face of the fixing element is spaced a second distance from the bottom face of the storage plate, wherein the first distance is greater than the second distance.

12. The domestic refrigerator according to claim 1, wherein the profile does not support the storage plate.

13. The domestic refrigerator according to claim 1, wherein the fixing element extends continuously along the length of the profile.

14. The domestic refrigerator according to claim 1, wherein the profile comprises a one-piece construction that spans from the right side to the left side of the storage plate.

15. The domestic refrigerator according to claim 1, wherein the visual section includes a visual section rear vertical face that extends directly from an upper-most face of the profile to the fixing element, the visual section rear vertical face being perpendicular to the upper-most face of the profile.

16. The domestic refrigerator according to claim 1, wherein the profile consists of the visual section and the fixing element, wherein the fixing element extends rearwardly from the visual section toward the storage plate, and wherein the adhesive is disposed exclusively on the bottom face of the storage plate.

* * * * *